US006270003B1

(12) United States Patent
Hirano

(10) Patent No.: US 6,270,003 B1
(45) Date of Patent: Aug. 7, 2001

(54) CAKE CONTAINER

(75) Inventor: Kunihiro Hirano, Gifu-ken (JP)

(73) Assignee: Hirano Shiki Co., Ltd., Gifu-ken (JP)

( * ) Notice: Subject to any disclaimer, the term of this patent is extended or adjusted under 35 U.S.C. 154(b) by 0 days.

(21) Appl. No.: 09/334,117

(22) Filed: Jun. 15, 1999

Related U.S. Application Data

(63) Continuation-in-part of application No. 08/624,444, filed on Apr. 3, 1996.

(30) Foreign Application Priority Data

Jun. 8, 1999 (JP) ..... 11-160645

(51) Int. Cl.[7] ..... B65D 3/00; B65D 3/10

(52) U.S. Cl. ..... 229/4.5; 229/5.5; 229/406; 229/400; 426/115; 206/815

(58) Field of Search ..... 259/4.5, 400, 406, 259/551; 47/72; 206/519, 815; 426/115

(56) References Cited

U.S. PATENT DOCUMENTS

| | | | | |
|---|---|---|---|---|
| 1,065,486 | | 6/1913 | Washburn . | |
| 1,069,675 | | 8/1913 | Claussen . | |
| 1,117,848 | | 11/1914 | House . | |
| 1,172,483 | | 2/1916 | Rike et al. . | |
| 1,230,090 | * | 6/1917 | House | 229/4.5 |
| 1,310,698 | * | 7/1919 | Hill | 229/4.5 |
| 1,766,226 | * | 7/1930 | Nias et al. | 229/4.5 |
| 1,807,407 | | 5/1931 | Hohnhorst . | |
| 2,016,434 | * | 10/1935 | Huntley | 229/4.5 |
| 2,041,437 | * | 5/1936 | Sidon | 229/4.5 |
| 2,046,628 | * | 7/1936 | Hoff, Jr. | 229/4.5 X |
| 2,304,278 | * | 12/1942 | Poster | 229/4.5 X |
| 2,355,559 | * | 5/1944 | Renner | 229/4.6 X |
| 2,459,073 | * | 1/1949 | Hamilton | 229/4.5 X |
| 2,530,124 | * | 11/1950 | Kieckhefer | 229/406 |
| 2,669,380 | * | 2/1954 | Grenier | 206/815 X |
| 2,967,652 | * | 1/1961 | Canfield et al. | 229/4.5 X |
| 3,223,305 | | 12/1965 | Edwards . | |
| 3,372,830 | | 3/1968 | Edwards . | |
| 3,381,882 | * | 5/1968 | Nostrand | 229/4.5 X |
| 3,733,023 | | 5/1973 | Arneson . | |
| 4,082,184 | | 4/1978 | Hammer . | |
| 4,114,760 | * | 9/1978 | entenmann | 206/562 |
| 4,279,933 | | 7/1981 | Austin et al. . | |
| 4,606,496 | * | 8/1986 | Marx et al. | 229/406 |
| 4,705,209 | | 11/1987 | Fujihara et al. . | |
| 5,152,101 | * | 10/1992 | Weder et al. | 47/72 |
| 5,181,339 | | 1/1993 | Weder et al. . | |
| 5,228,236 | | 7/1993 | Weder et al. . | |
| 5,339,565 | | 8/1994 | Weder et al. . | |
| 5,397,051 | | 3/1995 | Liu et al. . | |

FOREIGN PATENT DOCUMENTS

| | | | | |
|---|---|---|---|---|
| 0809999 | * | 3/1937 | (FR) | 229/4.5 |
| 611325 | * | 3/1937 | (GB) | 229/4.5 |
| 1 467 451 | | 3/1977 | (GB) . | |
| 57-36580 | | 11/1977 | (JP) . | |
| 57-134212 | | 8/1982 | (JP) . | |
| 57-36580 | | 8/1982 | (JP) . | |
| 2-99626 | | 8/1990 | (JP) . | |
| 0111246 | * | 5/1991 | (JP) | 229/4.5 |
| 3-105410 | | 10/1991 | (JP) . | |
| 4-10927 | | 1/1992 | (JP) . | |

* cited by examiner

*Primary Examiner*—Allan N. Shoap
*Assistant Examiner*—Tri M. Mai
(74) *Attorney, Agent, or Firm*—Sheridan Ross PC

(57) ABSTRACT

A cup-shaped cake container formed by bending a paper sheet. The container has a bottom and a sidewall. Step portions are formed in the sidewall. The step portions act against the restoring force of the material. A curved transitional wall is formed between the bottom and the sidewall.

10 Claims, 9 Drawing Sheets

CAKE CONTAINER

CROSS-REFERENCE TO RELATED APPLICATION

This application is a Continuation-in-Part of U.S. patent application Ser. No. 08/624,444 entitled "CAKE CONTAINER", filed on Apr. 3, 1996.

BACKGROUND OF THE INVENTION

The present invention relates to a cake container, and more specifically, to a cake container for forming and maintaining cake batter that is heated to expand in a predetermined configuration.

Conventional cup-like containers formed by bending sheet material such as paper are known for holding pound-cake and the like. For example, as shown in FIG. 12, a container body 20 comprises a bottom 21 corresponding to the bottom of a cake and a sidewall 22 protruding from the periphery of the bottom 21. The container body 20 consists of a sheet of material, which is shaped like a cup by press working. A fold 23 is defined on the surface of the material. The bottom 21 and the sidewall 22 are separated by the fold 23. Inner folds 24 and outer folds 25 are defined in the sidewall 22. The sidewall 22 is divided into a plurality of panels 26*a*–26*c* by the folds 24, 25.

Typically, aluminum foil is used as material for such a container. In this case, once the material is bent at the inner folds 24 and the outer folds 25, the folds are easy to form. Thus, the folds 24, 25 do not easily unfold, and the configuration of the sidewall 22 in the container body 20 is maintained.

If the material is made of synthetic resin, paper or the like, a restoring force that restores the material to its original flat shape is applied to the inner folds 24 and the outer folds 25 when the material is bent by press working. This leads to a problem in that the sidewall 22 loses its shape, and the intended configuration of the sidewall 22 cannot be properly maintained.

The bottom 21 and the side wall 22 form a relatively sharp corner. When manufacturing cakes, a cake in the container body 20 is moved from one step to a subsequent step by conveyers. When the container body 20 is passed from one conveyer to another, the side wall 22 and the bottom 21 are likely to be dented. The resultant cake may therefore be deformed. Further, the sharp corner about the bottom 21 causes the cooked cake to have overcooked or burnt portion about its bottom, which degrades the taste of the cake.

Accordingly, it is an object of the present invention to provide a container in which the configuration of the sidewall in the container body is maintained by making the folds defined on the sidewall resist unfolding.

SUMMARY OF THE INVENTION

To achieve these objects, an improvement of a cup-like container for holding a cake is provided. The container is formed by bending a sheet material and has a bottom and a sidewall, which are associated with the bottom surface and the side surface of the cake, respectively. The sidewall has folds and panels, which are defined by the folds, to form the container into a cup shape. Each panel has a step portion, which is transverse to the fold to hold the sidewall substantially upright.

More specifically, in a cake container according to the present invention, a bottom fold is defined on the surface of a sheet of material to be press-worked. The surface of the material is divided by the first fold into a bottom panel, which corresponds to the bottom of cake, and a sidewall. Second folds are formed in the sidewall. The sidewall is divided into a plurality of panels by these second folds. Furthermore, a step intersecting the second folds is formed in the sidewall to maintain the configuration of the sidewall. The folds are prevented from unfolding by the step. Further, the cake container according to the present invention has a curved transitional wall defined between the bottom panel and the sidewall. The transitional wall has a predetermined radius of curvature in a vertical cross sectional plane.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with accompanying drawings in which:

FIGS. 12*a* and 12*b* diagrams show conveyers for handling cakes using the containers of FIG. 8; and.

DETAILED DESCRIPTION OF THE PREFERRED EMBODIMENTS

Several embodiments of a cake container according to the present invention will be described hereinafter with reference to FIGS. 1–3.

Figure 1:
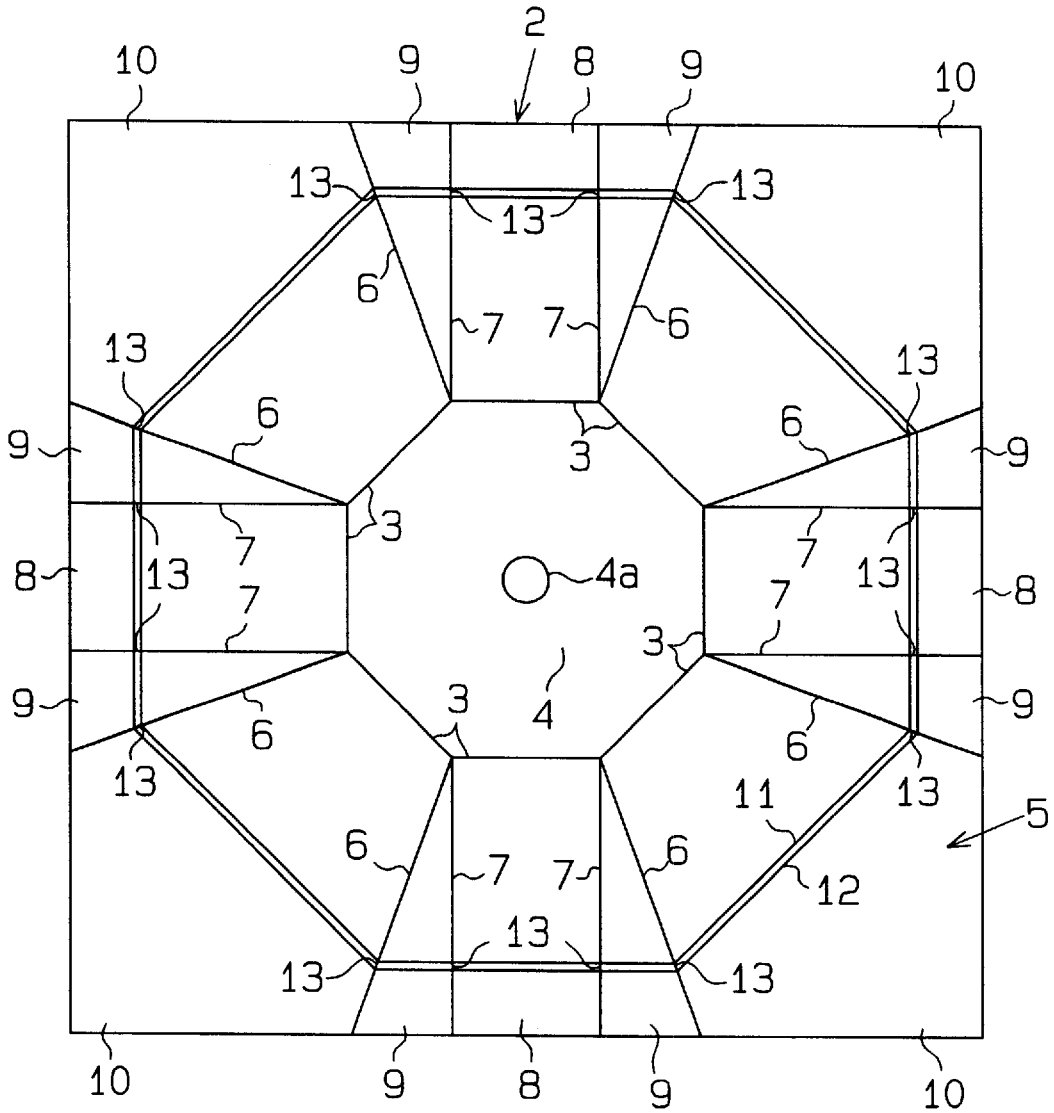
FIG. 1 is a plan view showing unfolded material of one embodiment according to the present invention.
Figure 2:
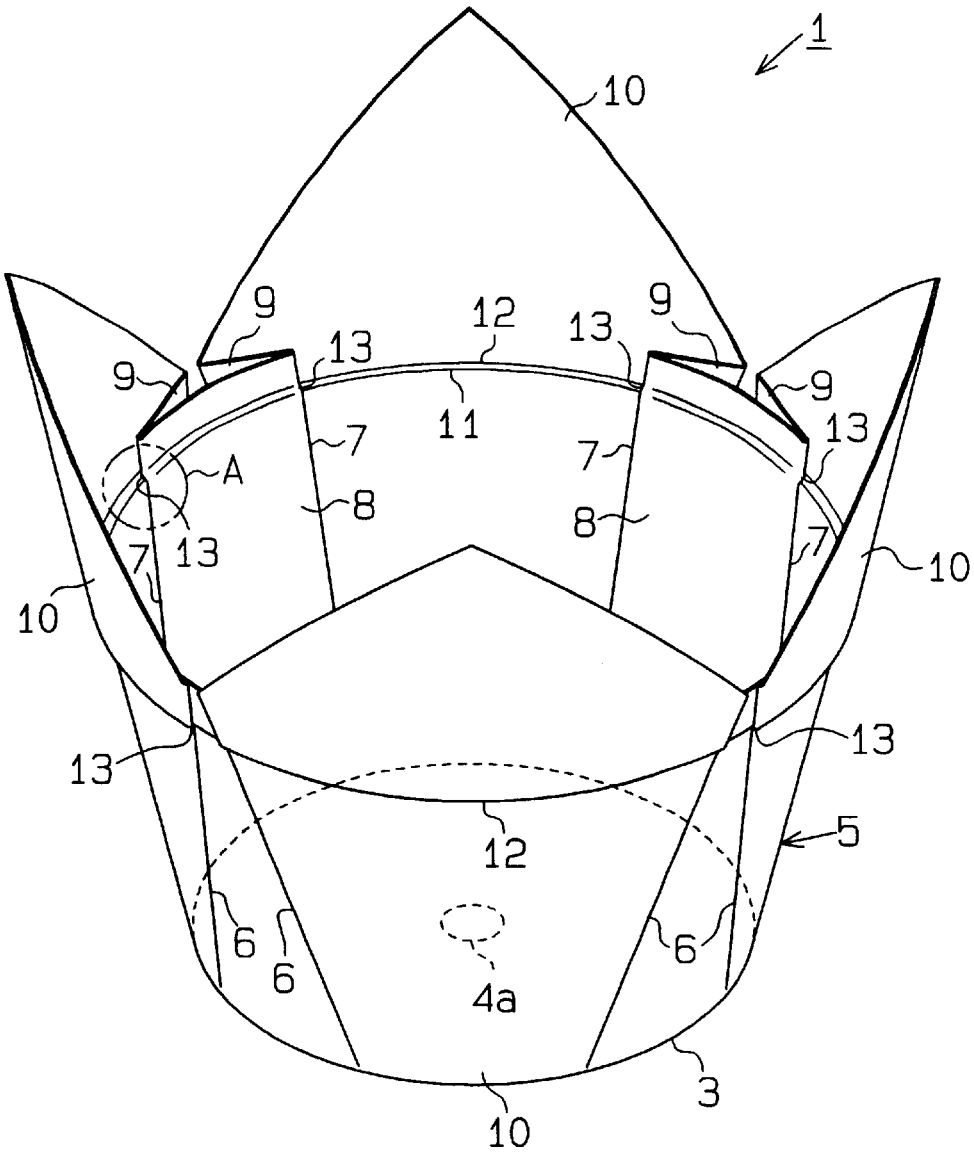
FIG. 2 is a perspective view showing a container body.
Figure 5:
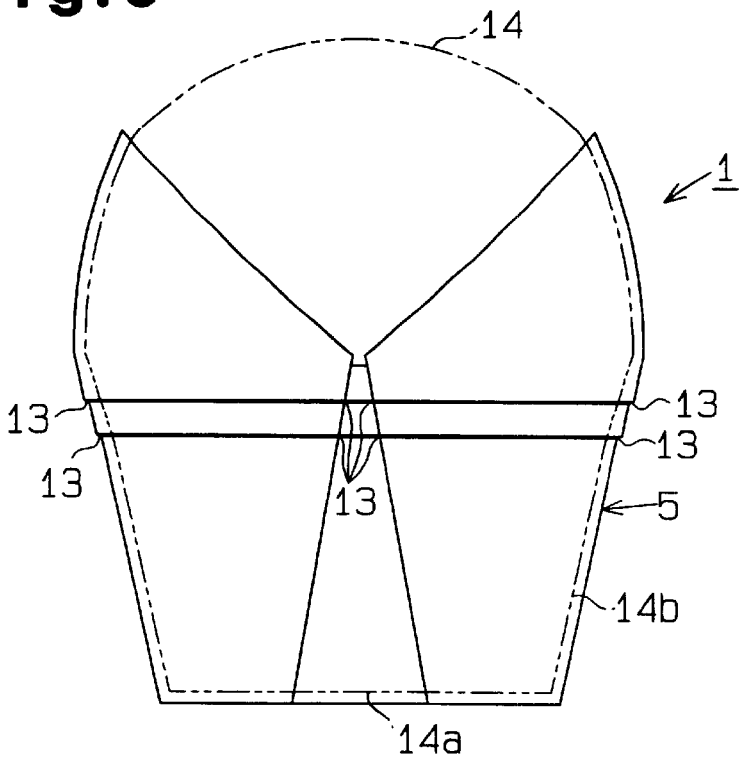
FIG. 5 is a side elevation view showing the container body of FIG. 4.
Figure 6:
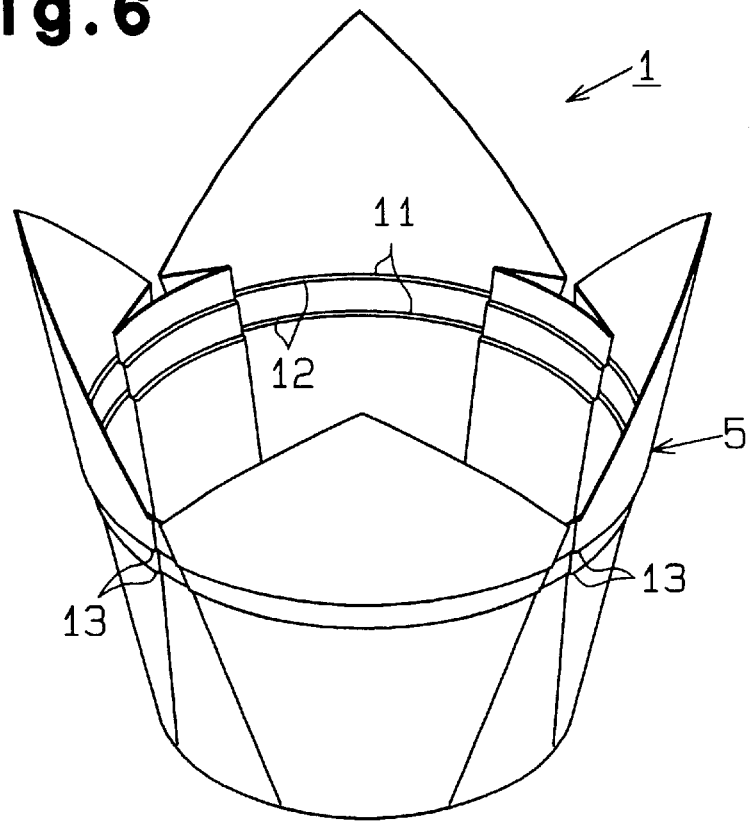
FIG. 6 is a perspective view showing the container body of FIG. 4.
Figure 7:
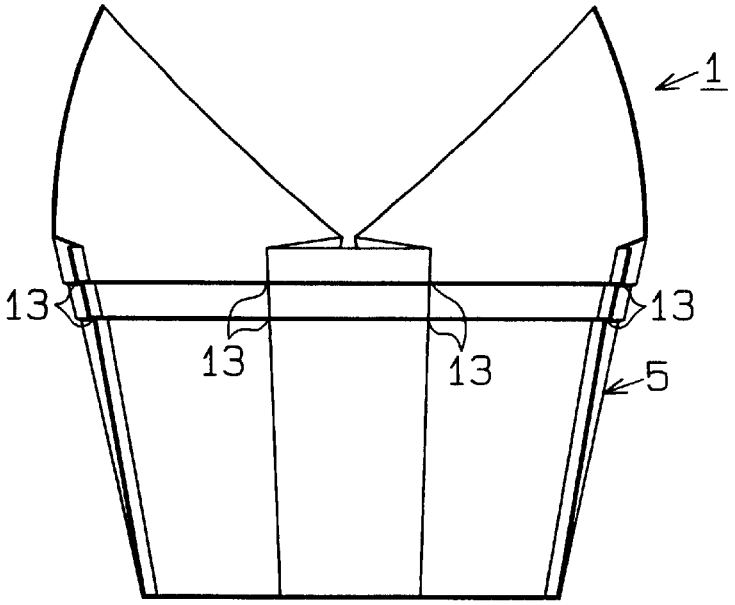
FIG. 7 is a side elevation view showing the container body of FIG. 4.

As shown in FIGS. 1 and 2, material that forms a container body 1 in a circular cup-like shape is a thin sheet 2 of paper. The sheet 2 is water-proof and grease-proof and is square. An octagonal bottom fold 3 is centrally formed by press working. The surface of the sheet 2 is divided by the octagonal bottom fold 3 into a bottom wall 4, which corresponds to the bottom 14*a* of a cake 14 illustrated in FIG. 5, and a sidewall 5, which corresponds to the side 14*b* of the cake. A circular air hole 4*a* is formed at the center of the bottom wall 4. When cake batter is baked, hot air is introduced via the air hole 4*a* into the container body 1, and the cake batter is baked with the introduction of the hot air.

Radial folds 6 are formed on the surface of the sheet 2 that corresponds to the side wall 5 by press working, such that the folds 6 extend diagonally from the corners of the bottom wall 4 toward the periphery of the sheet 2. Likewise, orthogonal folds 7 (second folds) are formed on the surface of the sheet 2 that corresponds to the side wall 5 by press working, such that the orthogonal folds 7 extend from the corners of the bottom wall 4 orthogonally toward the periphery of the sheet 2. The sidewall 5 is divided by the radial folds 6 and the orthogonal folds 7 into rectangular, or first, bent panels 8, triangular, or second, bent panels 9 and pentagonal, or third, bent panels 10.

In the rectangular, triangular and pentagonal panels 8, 9 and 10, a pair of step-like folds 11, 12 that extend parallel to the bottom fold 3 and intersect the radial folds 6 and the orthogonal folds 7 are formed by press working. All the folds 3, 6, 7, 11, 12 are formed with one forming die at one location. FIG. 1 shows the sheet 2 spread out in a flat manner after the press work.

Figure 3:
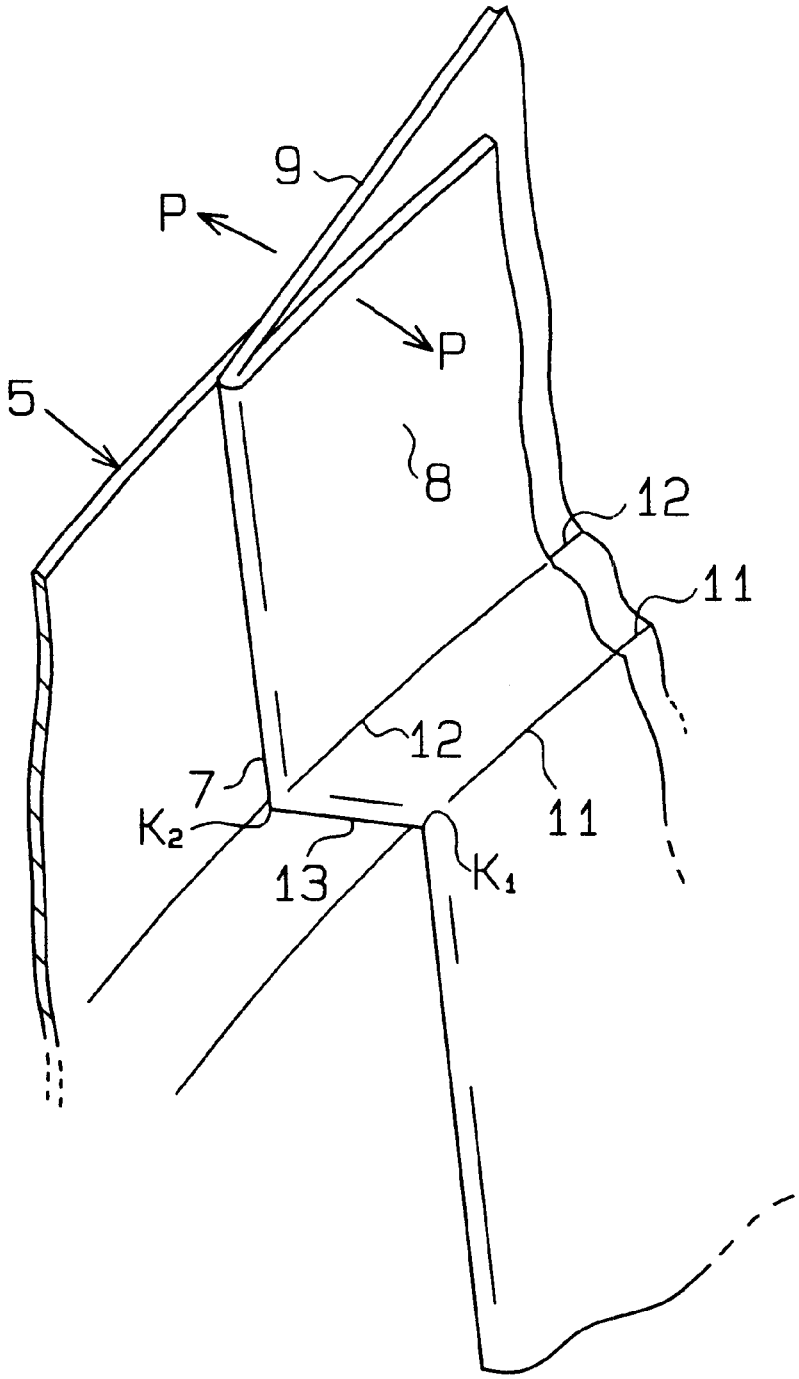
FIG. 3 is an enlarged perspective view showing a region A in FIG. 2.
Figure 4:
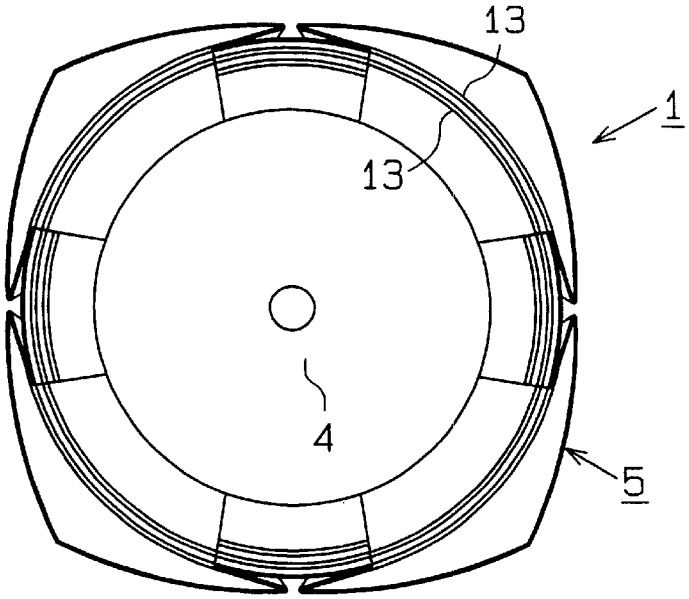
FIG. 4 is a plan view showing another embodiment of the container body, which is provided with two step portions.

As shown in FIG. 3, steps 13 are defined each corner between K1, where the inner step-like fold 11 and the orthogonal folds 7 intersect, and K2, where the outer fold 12 and the orthogonal folds 7 intersect. Similarly, steps 13 are also formed on the radial folds 6 between points of intersection of the radial folds 6 and the inner and outer step-like folds 11 and 12. More specifically, the steps 13 are formed by the step-like folds 11, 12 and are located at the upper part of the sidewall 5. The angles defined by the steps 13 and each fold 6,7 are substantially right-angles. In the preferred embodiment, the width of the step 13 is approximately 1 mm. Although one of the orthogonal folds 7 is shown in FIG. 3, the radial folds 6 also form steps 13 in a like manner.

The method of forming and the benefits of the container described above follow.

When the container body 1 is formed, the sidewall 5 is bent by a one-step press operation at the bottom fold 3. The rectangular panels 8 and the triangular panels 9 are folded along at the orthogonal folds 7. The triangular bent panels 9 and the pentagonal panels 10 are folded along the radial folds 6 Then, the rectangular, triangular and pentagonal panels 8, 9 and 10 are respectively bent further along at the inner step-like fold 11 and bent along the outer step-like fold 12. Then, steps 13 are formed by the step-like folds 11, 12 at each radial folds 6 and orthogonal fold 7.

As shown in FIG. 3, the restoring force that urges the panels 8, 9 toward their original flat state, which is indicated by the arrows P shown in FIG. 3, is applied to the orthogonal fold 7 due to the nature of material forming the sheet 2. This force tends to unfold the panels 8, 9. Although the restoring force P is also applied to the step 13, the orthogonal fold 7 does not unfold since the step 13 operates to resist the restoring force P. As a result, the rectangular and triangular panels 8 and 9 do not unfold outward relative to the container body 1. The same is also true with respect to the radial folds 6, which is not shown in FIG. 3. As a result, unfolding at the radial folds 6 and orthogonal fold 7 is prevented.

As described above, in the present embodiment, the step 13 is provided at each radial fold 6 and orthogonal fold 7 on the sidewall 5 of the container body 1 so that the steps 13 will serve to resist the restoring force P that operates to unfold each fold 6, 7. This prevents the rectangular, triangular and pentagonal bent panels 8, 9 and 10 on the sidewall 5 from unfolding and thus, the configuration of the sidewall 5 is sturdily maintained.

In addition, since the step 13 lies in the one plane, which is normal to the axis of the container, the resistance against the restoring force of the sheet 2 is applied uniformly along the periphery of the sidewall 5. Thus, the sidewall 5 is reliably prevented from unfolding.

Furthermore, the rectangular, triangular and pentagonal bent panels 8, 9 and 10 do not need adhesive in order to maintain the configuration of the sidewall 5. Thus, the sidewall 5 can be easily unfolded for unwrapping the cake inside.

In the present embodiment, the following results are achieved.

Since the material of the sheet 2 is paper, if a piece of metal is accidentally mixed in the cake batter and contained in the container body 1, the metal can be detected by a metal detector. This cannot be done if the container body 1 is made of aluminum foil.

Additionally, when the cake batter is baked, the paper sheet does not reflect heat as much as a container made of aluminum foil. Thus, the time for baking is reduced.

Moreover, unlike an aluminum foil container, the paper container 1 can be baked with a microwave range in addition to an oven. Thus, a variety of baking methods can be selected depending on the nature of the cake batter.

In addition, the cost of thin paper is less than the cost of aluminum foil, thereby reducing the overall manufacturing cost of the container body 1. Moreover, when the sheet 2 is disposed of, the incineration efficiency when burning paper, is higher since paper can be incinerated at a lower temperature than aluminum foil.

Furthermore, writing or illustrations can be printed on the outer surface of the sidewall 5 of paper, thereby improving the appearance of the container body 1.

Figure 8:
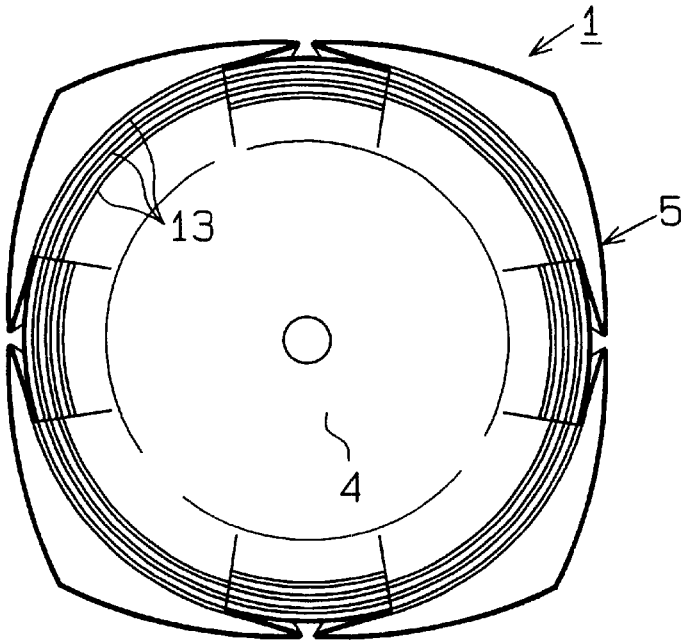
FIG. 8 is a plan view showing another embodiment of the container body, which is provided with three step portions.
Figure 9:
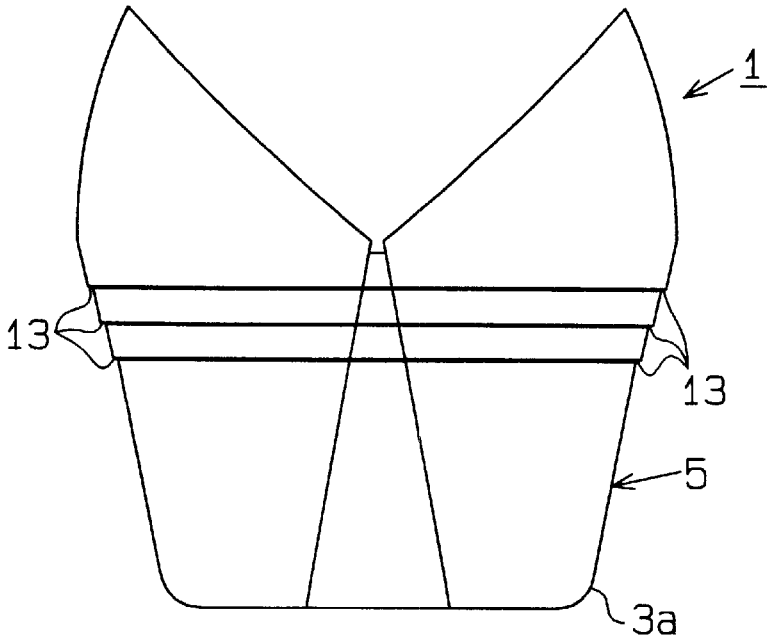
FIG. 9 is a side elevation view showing the container body in FIG. 8.
Figure 10:
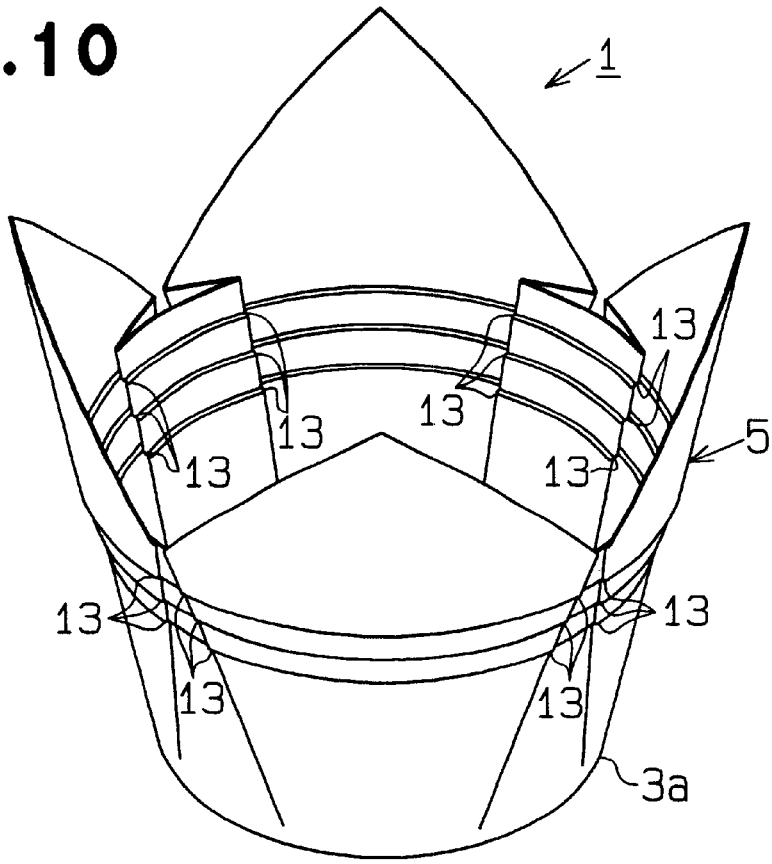
FIG. 10 is a perspective view showing the container body in FIG. 8.

The present invention can further be embodied as follows:

In the first embodiment, one step 13 is defined by a pair of step-like folds 11, 12. Two steps 13 may be formed as illustrated in FIGS. 4–7 or three may be formed as shown in FIGS. 8–10. These constructions enhance resistance against the restoring force of the sheet 2, thereby further preventing the sidewall 5 from deforming.

In a further embodiment, a container body 1 shown in FIGS. 8 to 10 includes a curved transitional wall 3*a* between the bottom wall 4 and the side wall 5. The bottom fold 3 of the embodiments of FIGS. 1 to 7 are omitted for forming the transitional wall 3*a*. The transitional wall 3*a* is formed by pressing the sheet 2.

Figure 11A:
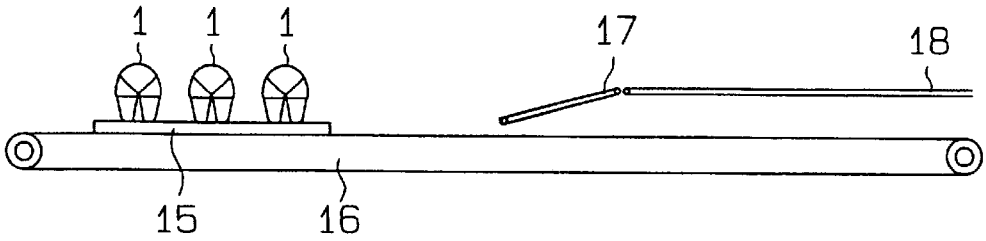
FIGS. 11*a*, 11*b* and 11*c* are diagrams showing steps for manufacturing cakes using the containers of FIG. 8.
Figure 11B:
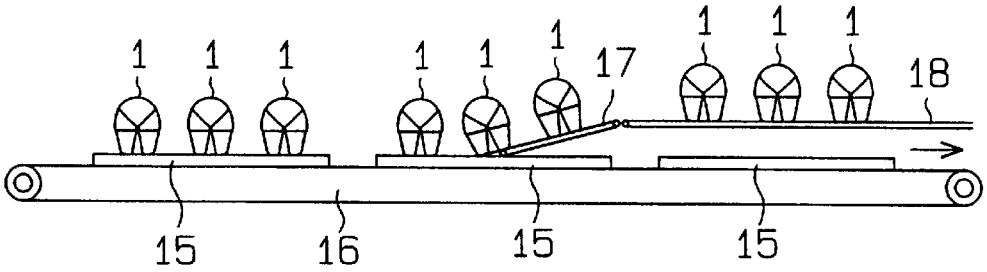
Figure 11C:
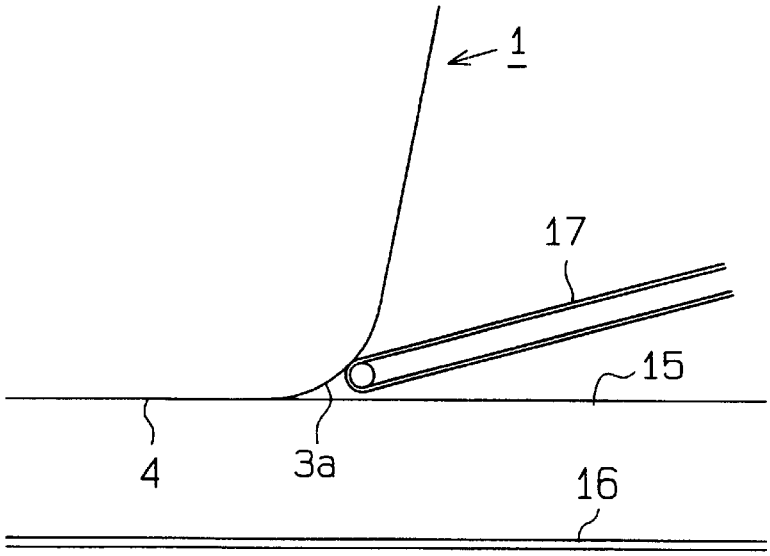

FIGS. 11*a* and 11*b* show steps of a process for manufacturing cakes using the container bodies 1 of FIGS. 8–10. The container bodies 1 are placed on a sheet iron 15 and moved by a first belt conveyor 16 from left to right as viewed in FIG. 11*a*. In a previous step (not shown), cake batter in the container bodies 1 has been heated. By the time the steps of FIGS. 11*a*, 11*b* are performed, the cakes in the container bodies 1 have been baked. A second belt conveyor 17 is located adjacent to the first conveyor 16 for collecting the baked cakes. The paths of the second conveyor 17 an d the first conveyor 16 form a predetermined angle. The upstream end of the second conveyor 17 is separated from the surface of the first conveyor 16 by a distance substantially equal to the thickness of one of the iron plates 15. As shown in FIG. 11*c*, the baked cakes and the container bodies 1 are passed to the second conveyor 17. on the other hand, the iron plates 15 remain on the conveyor 16 and are moved by the first conveyor 16 to the downstream of the first conveyor 16. The plates 15 are then recovered. The cakes in the container bodies 1 on the second conveyor 17 are passed to a third conveyor 18. The third conveyor 18 carries the cakes to a subsequent step (for example, a wrapping step).

The cake container of FIGS. 8–11*c* has the curved transitional wall 3*a* formed adjacent to the bottom of the container body 1. This construction allows a cake, together with the container, to smoothly move onto the second conveyor 17. In other words, the containers 1 are not deformed when transferred from one conveyor to another, which would often occur if there were no transitional wall 3*a*.

The cake container of FIGS. 8 to 11*c* has the following advantages.

If cakes are baked by using containers having no transitional wall 3*a*, cake batter located at the corner between the sidewall and the bottom tends to be overcooked or burnt. This is because the cake batter receives heat from both the side wall and the bottom of the container. The transitional wall 3*a* prevents cake batter located at the corner from receiving excessive heat. As a result, the cake batter at the periphery of the bottom is not overcooked, which improves the taste of the cake.

To smoothly move the container bodies 1 onto the second conveyor 17, the radius of curvature of the transitional wall 3*a* is preferably between 6 mm and 20 mm. More preferably, the radius of curvature of the transitional wall 3*a* is between 8 mm and 20 mm. If the radius of curvature of the transitional wall 3*a* is smaller than 6 mm, a cake baked by the container body 1 may be burnt or overcooked at the periphery of the bottom. On other hand, if the radius of curvature of the transitional wall 3*a* is greater than 20 mm, the cake in the container body 1 is unstable and may tip over.

When a person eats the cake with a fork or spoon, the part of the cake adhered to the inner surface of the transitional wall 3*a* is easily removed. In other words, the transitional wall 3*a* makes it easier to eat the cake.

The transitional wall 3*a* also offers cakes and container bodies having a novel and eye catching appearance.

Figure 12A:
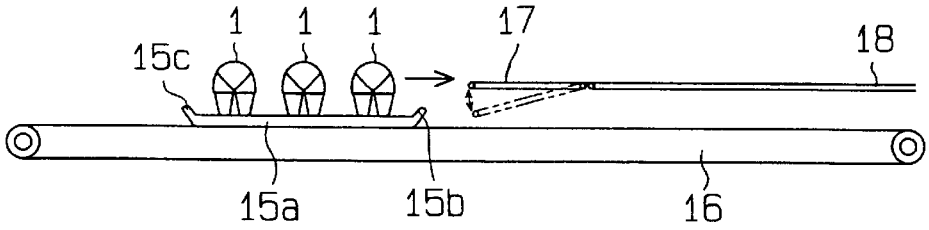
Figure 12B:
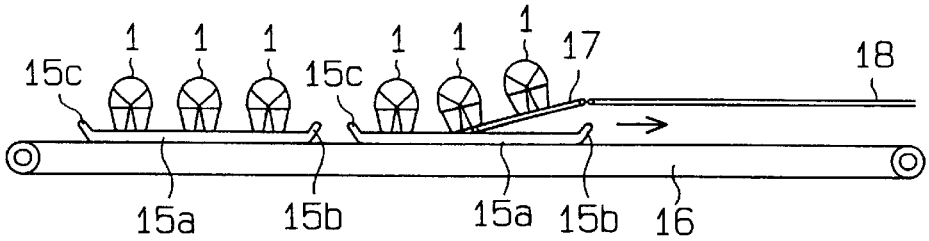
Figure 13:
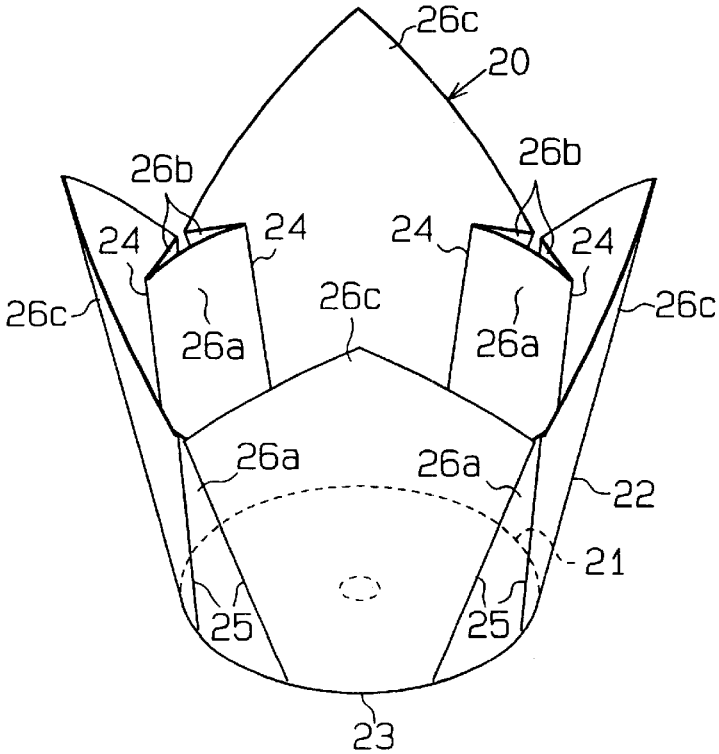
Fig.13(Prior Art)
FIG. 13 is a perspective view showing a prior art cake container.

FIGS. 12*a* and 12*b* show another embodiment. In this embodiment, the container bodies 1 with cakes inside are placed on trays 15*a*. Each tray 15*a* has a rim formed continuously along its periphery. In FIGS. 12*a* and 12*b*, only front and rear portions 15*b*, 15*c* of the rim are shown. A second conveyer 17 is pivoted between a horizontal position shown in FIG. 12*a* and an inclined position shown in FIG. 12*b*.

The tray 15*a* is moved on the conveyer 16 with the container bodies 1 on it. When the front rim portion 15*b* approaches near the conveyer 17, the conveyer 17 is moved from the inclined position shown by a dotted line in FIG. 12*a* to the horizontal position shown by a solid line. Thus, the rim portion 15*b* does not interfere with the conveyer 17.

When a predetermined period has elapsed after the front rim portion 15*b* passes the upstream end of the conveyor 17, the conveyer 17 is moved to the inclined position. Then, as shown in FIG. 12*b*, the tray 15*a* is further moved and the container bodies 1 are passed to the conveyer 17.

When all the container bodies 1 on a tray 15*a* are passed to the conveyer 17 and the rear rim portion 15*c* approaches the upstream end of the conveyer 17, the conveyer 17 is moved from the inclined position to the horizontal position.

In the embodiment of FIGS. 12*a*, 12*b*, the trays 15*a* having a rim are used. Therefore, if oil leaks from the cakes, the rim prevents the oil from spilling from the tray 15*a*. Also, the rim prevents the cakes from falling off the tray 15*a*.

In the embodiments of FIGS. 1 to 11*c*, the steps 13 are formed circularly on the sidewall 5. However, the step portions 1 may be formed in a zigzag pattern as long as the step portions 1 intersect the radial folds 6 and the orthogonal folds 7.

In the embodiments of FIGS. 1 to 11*c*, the container body 1 includes the steps 13, which result in an outward bend of the container body 1, and the rectangular, triangular and pentagonal panels 8 to 10, which are bent outward at the steps 13. The arrangement of the steps 13 and the bent panels 8 to 10 may be reversed. The reversal of the steps 13 and the bent panels 8 to 10 results in the same advantages that result from the embodiment of FIGS. 1 to 11*c*. In other words, the radial folds 6 may be inner folds, and the orthogonal folds 7 may be outer folds.

The width of steps 13 is preferably between 0.2 mm and 5.0 mm. However, the width of the steps 13 may be out of this range.

The bottom wall 4 of the container body 1 may have a shape other than a circle. For example, the bottom wall 4 may be shaped like a triangle or a square.

The material, size and shape of the sheet 2 may be arbitrarily determined.

The number, shape and arrangement of the air hole 4*a* may be arbitrarily determined.

The shape of the panels 10 may be arbitrarily determined.

Therefore, the present examples and embodiments are to be considered as illustrative and not restrictive and the invention is not to be limited to the details given herein, but may be modified within the scope and equivalence of the appended claims.

What is claimed is:

1. A cup-like food container formed by bending a single sheet of material, wherein the container has a substantially flat bottom wall and a side wall surrounding the bottom wall, the container comprising:

a hole formed in the bottom wall;

a plurality of overlapping folds provided in the side wall, wherein said overlapping folds extend from said flat bottom to the periphery of said sheet, and wherein each of the plurality of overlapping folds extend from the flat bottom to an opening of the food container;

a plurality of panels defined by the folds in the side wall;

a step formed in the side wall transverse to the folds to resist unfolding of said folds; and a transitional wall defined between the bottom wall and the side wall, wherein the transitional wall is a curved surface having a predetermined radius of curvature in a vertical cross sectional plane.

2. The food container according to claim 1, wherein the predetermined radius of curvature is from 6 mm to 20 mm.

3. The food container according to claim 1, wherein the material is paper.

4. A cup-like food container formed by bending a single thin sheet of material, wherein the container has a substantially flat bottom wall and a side wall, the container comprising:

a hole formed in the bottom wall;

a plurality of overlapping folds provided in the side wall, wherein each overlapping fold extends from the bottom wall to the edge of the sheet, and wherein each of the plurality of overlapping folds extend from the flat bottom to an opening of the food container;

a plurality of panels defined said folds in the side wall to form the container in a cup shape;

a step formed in the side wall transversely to the folds to resist unfolding of the folds; and a curved transitional wall surrounding the bottom wall and extending between the bottom wall and the side wall, wherein the curved transitional wall has a predetermined radius of curvature in a vertical cross sectional plane vertical to the bottom wall.

5. The food container according to claim 4, wherein the predetermined radius of curvature is from 6 mm to 20 mm.

6. The food container according to claim 4, wherein the material is paper.

7. A cup-like cake container formed by bending a single thin sheet of material, wherein the container has a substantially flat bottom wall and a side wall, the container comprising:

a hole formed in the bottom wall;

a plurality of overlapping folds provided in the side wall, wherein each overlapping fold extends from the bottom wall to the edge of the sheet, and wherein each of the plurality of overlapping folds extend from the flat bottom to an opening of the cake container;

a continuous step formed in the side wall transversely to the folds to resist unfolding of the folds; and a curved transitional wall surrounding the bottom wall and extending between the bottom wall and the side wall, wherein the curved transitional wall has a predetermined radius of curvature in a vertical cross sectional plane.

8. The cake container according to claim 7, wherein the predetermined radius of curvature is from 6 mm to 20 mm.

9. The cake container according to claim 7, wherein the material is paper.

10. A cake baked in the cake container according to claim 7, wherein the cake is baked inside the container so that the cake has an outer transition wall corresponding to the curved transitional wall of the container, wherein the outer transition wall has the predetermined radius of curvature in a vertical cross sectional plane.

* * * * *